United States Patent [19]

Kimura et al.

[11] 4,332,467

[45] Jun. 1, 1982

[54] DEVELOPING DEVICE IN ELECTROSTATIC COPYING APPARATUS

[75] Inventors: Hiroshi Kimura, Neyagawa; Toshikazu Matsui, Kishiwada; Masahiko Hisajima, Osaka; Yutaka Shigemura, Takarazuka; Yoichiro Irie, Suita; Kiyoshi Morimoto, Osaka, all of Japan

[73] Assignee: Mita Industrial Co., Ltd., Osaka, Japan

[21] Appl. No.: 163,775

[22] Filed: Jun. 27, 1980

[30] Foreign Application Priority Data

Feb. 27, 1980 [JP] Japan ..... 55/22699

[51] Int. Cl.[3] ..... G03G 15/00

[52] U.S. Cl. ..... 355/14 D; 222/DIG. 1; 355/3 DD

[58] Field of Search ..... 355/14 D; 3 DD; 222/DIG. 1; 118/689-691

[56] References Cited

U.S. PATENT DOCUMENTS

| | | | |
|---|---|---|---|
| 3,233,781 | 2/1966 | Grubbs | 355/14 D |
| 3,876,106 | 4/1975 | Powell et al. | 355/14 D |
| 4,032,227 | 6/1977 | Hubbard et al. | 355/14 D |
| 4,197,813 | 4/1980 | Yano et al. | 222/DIG. 1 |
| 4,200,665 | 4/1980 | Suzuki et al. | 355/14 D |
| 4,222,497 | 9/1980 | Lloyd et al. | 222/DIG. 1 |
| 4,226,525 | 10/1980 | Sakamoto et al. | 355/14 D |
| 4,230,070 | 10/1980 | Murasaki et al. | 222/DIG. 1 |
| 4,241,696 | 12/1980 | Huzll | 355/14 D |
| 4,257,348 | 3/1981 | Prohaska | 222/DIG. 1 |

*Primary Examiner*—R. L. Moses

*Attorney, Agent, or Firm*—Wenderoth, Lind & Ponack

[57] ABSTRACT

A developing device in an electrostatic copying apparatus. The developing device includes a developer container, a developer applicator for holding on its surface a pair of a developer present in the developer container and applying toner particles to a latent electrostatic image to be developed, and a toner particle dispenser for dispensing toner particles therein to the developer container. The toner particle dispenser is controlled such that it performs a toner particle dispensing action in response to the performance of a copying process by the electrostatic copying apparatus. The developing device is provided with a device for inhibiting the dispensing of toner particles which makes the toner particle dispenser unable to start a toner particle dispensing action when a sufficient amount of the developer is present in the developer container.

18 Claims, 6 Drawing Figures

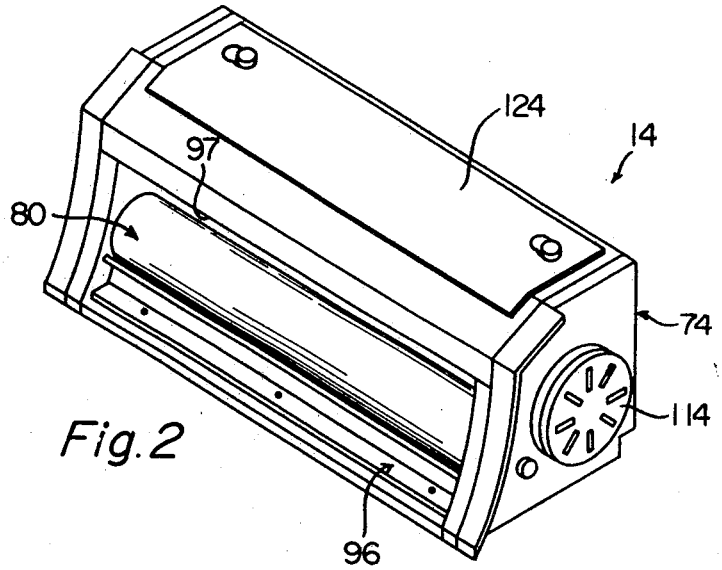
Fig. 2
Fig. 3
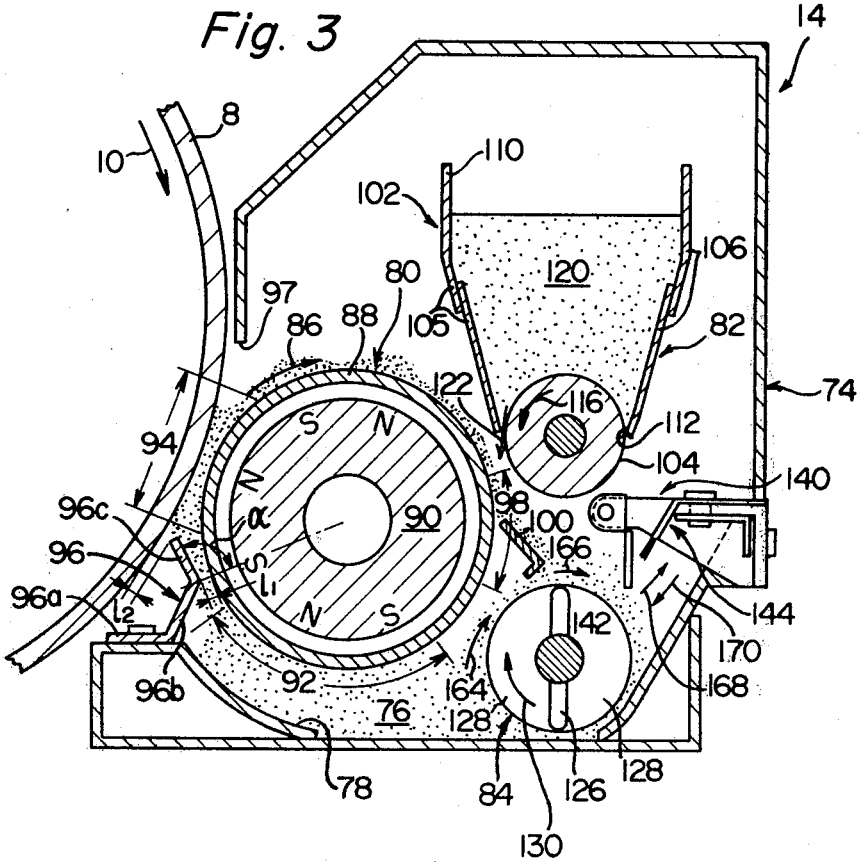

DEVELOPING DEVICE IN ELECTROSTATIC COPYING APPARATUS

FIELD OF THE INVENTION

This invention relates to a developing device in an electrostatic copying apparatus, and more specifically, it relates to a developing device for developing a latent electrostatic image by applying toner particles thereto in an electrostatic copying apparatus.

DESCRIPTION OF THE PRIOR ART

Various types of developing apparatus for developing a latent electrostatic image by applying toner particles thereto in an electrostatic copying apparatus have been suggested and come into commercial acceptance. The most widely used type is a developing apparatus which includes a developer container, a developer applicator for holding on its surface a part of a developer present in the developer container and applying toner particles to a latent electrostatic image to be developed, and a toner particle dispenser for dispensing toner particles therein to said developer container.

In order to perform good development as desired in such a type of developing apparatus, it is important that the dispensing of toner particles from the toner dispenser to the developer container be properly controlled to maintain the amount of the developer present in the developer container always at a suitable amount. This requirement is particularly important when the developer present in the developer container is a so-called two-component developer comprising magnetic carrier particles and toner particles.

As is known to those skilled in the art, when the developer present in the developer container is a two-component developer, the developer applicator holds on its surface both carrier particles and toner particles, but applies only the toner particles to a latent electrostatic image. Accordingly, only the toner particles are consumed as the development is carried out, and the carrier particles are substantially not consumed and there is substantially no change in the amount thereof. The decrease of the amount of the developer in the developer container, therefore, means a decrease in the ratio of the toner particles to the carrier particles. When the amount of the developer present in the developer container decreases excessively and the quantitative ratio of toner particles to carrier particles decreases excessively, the density of the developed image is reduced, thus causing the phenomenon of insufficient development. Accordingly, when the toner particles are consumed during development and the amount of the developer present in the developer container decreases, it is necessary to supply toner particles from the toner dispenser to the developer container. On the other hand, when an excessive amount of toner particles is dispensed from the toner dispenser to the developer container and the amount of the developer present in the developer container increases excessively, the qunatitative ratio of the toner particles to carrier particles increases excessively, and consequently, the phenomenon of background fog occurs in the developed image. In order, therefore, to achieve good development, it is necessary to supply toner particles properly from the toner dispenser to the developer container in response to the consumption of the toner particles in the developing operation.

As a matter of course, no change in the ratio of toner particles as described above occurs when the developer present in the developer container is a so-called one-component developer consisting only of toner particles. But in using the one-component carrierless toner, too, it is desirable to maintain the amount of the developer present in the developing device always at a suitable amount in order to secure uniformity in the operations of various constituent elements of the developing device, especially the developer applicator.

Thus, in a conventional developing device of the type which includes a toner particle dispenser for dispensing toner particles therein to the developer container, the toner particle dispenser is controlled so that the toner particles are supplied to the developer container in response to the performance of a copying process by the electrostatic copying apparatus. For example, in one example of the conventional developing apparatus, the toner dispensing action of the toner dispenser is started when the forward end of the copying paper has reached a predetermined position in a paper conveying passage during the performance of a copying process by the electrostatic copying apparatus, and is terminated when the rear end of the copying paper has gone past the aforesaid predetermined position.

It has been found, however, that the controlling of the toner dispenser in the conventional developing apparatus does not offer a complete solution to the problem associated with it. The significant point here is that the aforesaid control of the toner dispensing action in the conventional developing apparatus is not based on the amount of toner particles actually consumed in the development or the amount of the developer actually present in the developer container, but merely makes it possible to dispense a predetermined amount of toner particles to the developer container every time development is carried out. The amount of toner particles consumed in each developing cycle varies considerably depending upon the properties of the latent electrostatic image to be developed, for example dependng upon whether a background portion free from toner particles is larger than a solid black portion having many toner particles adhering thereto, or vice versa. Accordingly, when a latent electrostatic image having a large background area is repeatedly developed in the conventional developing apparatus, the amount of the developer present in the developer container is likely to increase excessively. Conversely, when a latent electrostatic image having a large solid black area is repeatedly developed, the amount of the developer in the container is likely to decrease excessively. Generally, the excessive increase of the amount of the developer so as to cause background fog is more permissible than an excessive decrease to cause insufficient development. Accordingly, the conventional developing device is usually so designed that a slightly excessive amount of toner particles is dispensed from the toner dispenser to the developer container for each cycle of development. The amount of the developer present in the developer container consequently tends to increase excessively.

SUMMARY OF THE INVENTION

It is a primary object of this invention to provide a novel and excellent developing device in an electrostatic copying apparatus of the type including a toner particle dispenser for dispensing toner particles therein to a developer container wherein an excessive increase of the amount of developer in the developer container can be surely prevented.

The present invention provides, in a developing device in an electrostatic copying apparatus, said developing device including a developer container, a developer applicator for holding on its surface a part of a developer present in said developer container and applying toner particles to a latent electrostatic image to be developed, and a toner particle dispenser for dispensing toner particles therein to said developer container, said toner particle dispenser being controlled such that it performs a toner particle dispensing action in response to the performance of a copying process by the electrostatic copying apparatus, the improvement wherein said developing device further includes a means for inhibiting the dispensing of toner particles, said inhibiting means being adapted to make the toner particle dispenser unable to start a toner dispensing action when a sufficient amount of the developer is present in the developer container.

When a sufficient amount (slightly larger than the optimal amount) of developer is present in the developer container in the developing device of this invention, the start of the toner dispensing action of the toner dispenser is inhibited by the toner dispensing inhibitor means, and the excessive increase of the developer in the developer container is thus surely prevented. On the other hand, the excessive decrease of the developer present in the developer container can be avoided, as in the conventional developing device, by dispensing a slightly excessive amount of toner particles from the toner dispenser to the developer container in response to the performance of a copying process while the toner dispensing-inhibiting means is out of operation.

BRIEF DESCRIPTION OF THE ACCOMPANYING DRAWINGS

FIG. 2 is a perspective view of the developing device in the electrostatic copying apparatus shown in FIG. 1;

FIG. 3 is a partial, cross-sectional view of the developing device in the electrostatic copying apparatus shown in FIG. 1;

DETAILED DESCRIPTION OF PREFERRED EMBODIMENTS

Referring to the accompanying drawings, one embodiment of the developing device of this invention is described below in detail.

Figure 1:
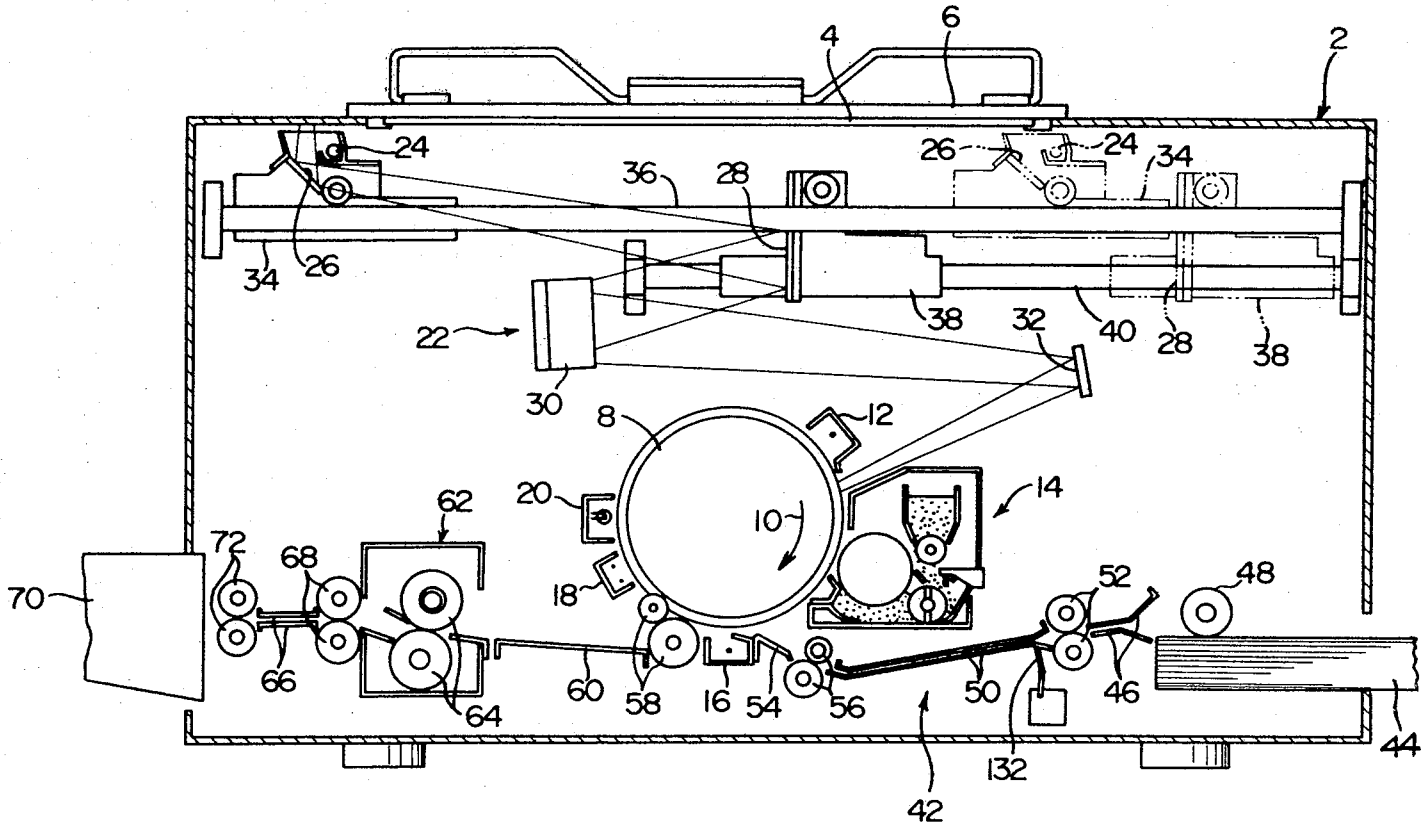
FIG. 1 is a simplified sectional view of an electrostatic copying apparatus equipped with one embodiment of the developing device of this invention.

Referring to FIG. 1, the structure of one example of an electrostatic copying apparatus equipped with one embodiment of the developing device of this invention is briefly described.

The electrostatic copying apparatus shown in the drawings has a substantially parallelpipedal housing shown generally at 2. The top surface of the housing 2 includes a transparent plate 4 on which to place an original to be copied, and an original-holding member 6 for covering the original placed on the transparent plate 4. A rotary drum 8 having a photosensitive member mounted on at least a part of its surface is disposed centrally in the lower part of the housing 2. The rotary drum 8 is adapted to be rotated in the direction of arrow 10, and viewed in the rotating direction of the rotary drum 8, a corona discharge device 12 for charging, a developing device shown generally at 14, a corona discharge device 16 for transfer, a corona discharge device 18 for charge elimination and a charge eliminating lamp 20 are arranged in this order along the peripheral surface of the rotary drum 8. The developing device 14 constructed in accordance with this invention in the electrostatic copying apparatus shown in the drawings performs both a developing action of applying toner particles to a latent electrostatic image formed on the photosensitive member on the rotary drum 8 to render it visible and a cleaning action of removing the remaining toner particles from the photosensitive member after the developed image on the photosensitive member has been transferred to a copying paper (the construction of the developing device 14 itself is described in detail hereinbelow).

Above the rotary drum 8 in the upper portion of the housing 2 is disposed an optical system 22 for projecting the image of an original placed on the transparent plate 4 onto the photosensitive member on the rotary drum 8 within an exposing zone between the charging corona discharge device 12 and the developing device 14. The optical system 22 shown in the drawings comprises an original-illuminating lamp 24, a first reflecting mirror 26, a second reflecting mirror 28, an in-mirror lens 30 and a third reflecting mirror 32. The original-illuminating lamp 24 and the first reflecting mirror 26 are secured to a first support frame 34 which is slidably mounted on a pair of suspending rods 36 (only one of them is shown in FIG. 1) extending substantially horizontally within the housing 2. The second reflecting mirror 28 is secured to a second support frame 38 which is slidably mounted on a pair of suspending rods 40 (only one of them is shown in FIG. 1) extending substantially horizontally below the suspending rods 36. The in-mirror lens 30 and the third reflecting mirror 32 are fixed at predetermined positions within the housing 2. In projecting the image of an original on the transparent plate 4 onto the photosensitive member on the rotary drum 8 by the optical system 22, the first support frame 34 and therefore the original-illuminating lamp 24 and the first reflecting mirror 26 secured thereto are moved at a predetermined velocity v from the positions shown by solid lines toward the positions shown by two-point dash lines, and simultaneously, the second support frame 38 and therefore the second reflecting mirror 28 secured thereto are moved at a velocity half of the velocity v (i.e. $\frac{1}{2}$ v) from the positions shown by the solid lines toward the positions shown by the two-point dash lines. As a result, the image of the original which is illuminated and scanned by the lamp 24 is projected on the photosensitive member on the rotary drum 8 through the first reflecting mirror 26, the second reflecting mirror 28, the in-mirror lens 30 and the third reflecting mirror 32.

A copying paper conveying system shown generally at 42 is provided below the rotary drum 8 in the lower portion of the housing 2. The paper conveying system 42 shown in the drawing comprises a paper feed roller 48 for separating one sheet of copying paper from a supply of paper in a paper cassette 44 mounted on one side portion (the right side portion in FIG. 1) of the housing 2 and feeding it through a pair of guide plates 46; a pair of conveyor rollers 52 for conveying the fed copying paper through a pair of guide plates 50; a pair of conveyor rollers 56 for receiving the copying paper conveyed through the guide plates 50 and conveying it through guide plates 54 to a transfer zone in which the transfer corona discharge device 16 is disposed; a pair of separating rollers 58 for separating the copying paper closely adhering to the photosensitive member on the rotary drum 8 in the transfer zone and conveying it from the transfer zone; a pair of press rollers 64 which constitute a fixing means 62 for pressing the copying paper sent from the separating rollers 58 along a guide plate 60 and thereby fixing the developed image transferred to the copying paper; a pair of conveyor rollers 68 for conveying the copying paper discharged from the fixing means 62 through a pair of guide plates 66; and a pair of conveyor rollers 72 for receiving the copying paper transferred through the guide plates 66 and discharging it onto a receiver tray 70 mounted on the other side portion (the left side portion in FIG. 1) of the housing 2.

When the rotary drum 8 is rotated in the direction of arrow 10 in the electrostatic copying apparatus shown above, corona discharge is first applied to the photosensitive member on the rotary drum 8 by the corona discharge device 12 to charge the surface of the photosensitive member to a specified polarity, and then the image of an original placed on the transparent plate 4 is projected onto the photosensitive member by the optical system 22 to form a latent electrostatic image on the photosensitive member. Next, toner particles are applied to the latent electrostatic image on the photosensitive member by the developing action of the developing device 14 to develop it. In the meanwhile, the paper conveying system 42 conveys a sheet of copying paper to the transfer zone in synchronism with the rotation of the rotary drum 8, and thus, under the action of the transfer corona discharge device 16, the developed image on the photosensitive member is transferred to the copying paper. The copying paper to which the developed image has been transferred is further conveyed by the conveyor system 42, and the developed image is fixed to the copying paper by the action of the fixing means 62. Thereafter, the copying paper is discharged onto the receiver tray 70. During this time, the rotary drum 8 keeps rotating, and the charge remaining on the photosensitive member after the transfer is removed by the action of the corona discharge device 18 and the charge eliminating lamp 20. The rotary drum 8 further keeps rotating and rotates for the second turn, and by the cleaning action of the developing device 14, the residual toner particles on the photosensitive member after the transfer are removed from it.

The aforesaid structure and operation of the illustrated electrostatic copying apparatus are known and do not constitute part of the essential points of the developing device of this invention, and moreover, the illustrated electrostatic copying apparatus is only one example of electrostatic copying apparatus to which the developing device of the present invention is applicable. Accordingly, a detailed description of the structure and operation of the illustrated electrostatic copying apparatus is omitted in the present specification.

Figure 4:
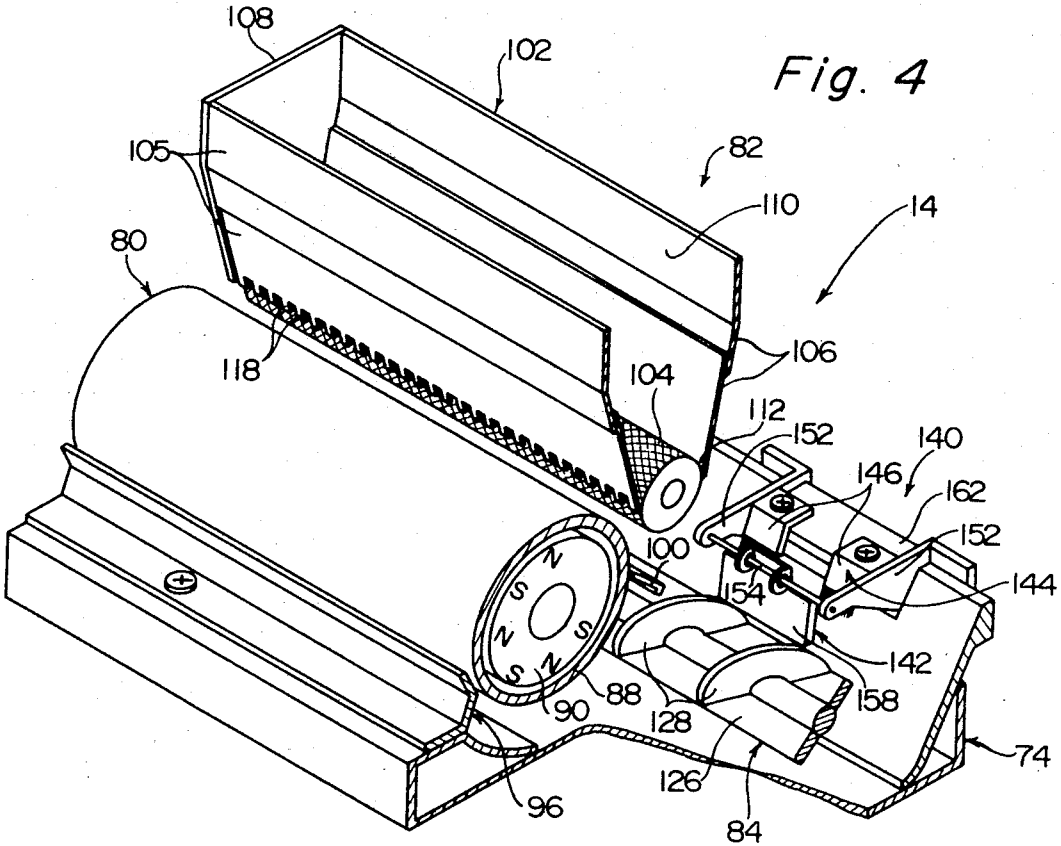
FIG. 4 is a perspective view, partly broken away, of the developing device in the electrostatic copying apparatus shown in FIG. 1.

Now, referring to FIGS. 2 to 4, the structure of the developing device 14 is described in more detail.

The developing device 14 shown in the drawings has a developing housing shown generally at 74. As most clearly shown in FIG. 3, the lower portion of the developing housing 74 constitutes a developer container 78 for accomodating a developer 76 which is a so-called two-component developer consisting of carrier particles and toner particles. Within the housing 74 are disposed a developer applicator 80, a toner particle dispenser 82 and a rotary agitating member 84.

The developer applicator 80 is constructed of a rotary cylindrical sleeve 88 for rotation in the direction of arrow 86 (FIG. 3) and a roll-like stationary permanent magnet 90 disposed within the sleeve 88. The developer applicator 80 magnetically holds a part of the developer 76 present in the developer container 78 on the surface of the rotary sleeve 88 in a developer draw-up zone 92 by the action of a magnetic field generated by the stationary permanent magnet 90, and carries the developer 76 held thereon to a developing zone 94 by the rotation of the rotary sleeve 88. In the developing zone 94, the developer 76 held on the surface of the rotary sleeve 88 is brought into contact with the photosensitive member on the rotary drum 8 to be rotated in the direction shown by arrow 10 through an opening 97 formed in the front surface of the developing housing 74 (i.e., the surface facing the surface of the rotary drum 8). Thus, toner particles in the developer 76 are applied to the photosensitive member to develop a latent electrostatic image formed on the photosensitive member into a visible image (toner image) (when the developing device 14 performs a developing action). Or the toner particles remaining on the photo-sensitive member are removed from it by the brushing action of the developer 76 held on the surface of the rotary sleeve 88 against the photosensitive member and the magnetic attracting action of a magnetic field generated by the stationary permanent magnet 90, and are held on the rotary sleeve (when the developing device 14 performs a cleaning action).

A brush length-adjusting member 96 for adjusting the amount of the developer 76 held on the surface of the rotary sleeve 88 and carried to the developing zone 94, or the thickness of a layer of the developer 76 on the surface of the rotary sleeve 88, is provided between the developer draw-up zone 92 and the developing zone 94. Preferably, the brush length-adjusting member 96 has the configuration shown in FIG. 3 having a base part 96*a* fixed for fine adjustment at a predetermined position of the housing 74, a main part 96*b* extending from the base part 96*a* to a point close to the surface of the rotary sleeve 88, and an extension 96*c* extending from the forward end of the main part 96*b* to a point close to the surface of the rotary drum 8. In such brush length-adjusting member 96, the main part 96*b* located close to the surface of the rotary sleeve 88 performs the function of adjusting the brush length, whereby the thickness of the layer of the developer 76 held on the surface of the rotary sleeve 88 and carried to the developing zone 94 is defined by the distance $l_1$ between the forward end of the main part 96*b* and the surface of the rotary sleeve 88. On the other hand, the extension 96*c* serves to prevent toner particles in the developer 76 from scattering into the electrostatic copying apparatus from the developing zone 94 through the space between the developing housing 74 and the rotary drum 8. To achieve this purpose sufficiently, it is important that the extension 96c should extend to a position close to the photosensitive member on the rotary drum 8. Preferably, the distance $l_2$ between the forward end of the extension 96c and the photosensitive member on the rotary drum 8 is 0.5 to 1.5 mm, especially 0.8 to 1.2 mm. The extension 96c should desirably form an angle $\alpha$ of 90° to 110°, preferably 95° to 105°, to a straight line connecting the center of the rotary sleeve 88 to the forward end of the main part 96b. When the angle $\alpha$ is less than 90°, a part of the extension 96c approaches the surface of the rotary sleeve 88 to a larger extent than the forward end of the main part 96b to impair the brush length-adjusting function of the forward end of the main part 96b. If the angle $\alpha$ is more than 110°, a considerable clearance occurs between the extension 96c and the surface of the sleeve 88, and therefore toner particles which have fallen onto the surface of the extension 96c cannot be attracted again to the surface of the sleeve 88 by the magnetic action of the magnetic field generated by the stationary permanent magnet 90. Consequently, the toner particles undesirably remain on the surface of the extension 96c in the form of lumps.

Downstream of the developing zone 94 viewed in the rotating direction shown by arrow 86 of the sleeve 88 exists a separating zone 98 wherein the developer 76 held on the surface of the sleeve 88 is separated therefrom. The permanent magnet 90 is not magnetized at a part corresponding to the separating zone 98, and therefore, the magnetic field generated by the permanent magnet 90 is extremely weak in the separating zone 98 or is not present at all. A separating member 100 whose forward end makes contact with, or comes close to, the surface of the sleeve 88 is provided in the separating zone 98. In the separating zone 98, the developer 76 held on the surface of the rotary sleeve 88 is separated therefrom by the action of the forward end of the separating member 100 on the surface of the sleeve 88 coupled with the extremely weak intensity, or the absence, of the magnetic field. The developer 76 so separated flows down along the separating member 100 and falls toward the agitating member 84.

The toner particle dispenser 82 is constructed of a toner particle container 102 and a dispenser roller 104. The container 102 is defined by a front wall 105, a rear wall 106 and two side walls 108 (only one of them is shown in FIG. 4). A toner supply opening 110 is formed at its top portion, and a toner particle discharge opening 112 is formed at its bottom portion. The dispenser roller 104 is disposed rotatably in the toner discharge opening 112, and is rotated in the direction shown by arrow 116 by an electric motor 114 mounted on one side wall of the developing housing 74 (see FIG. 2). Preferably, the lower portions of the front wall 105 and the rear wall 106 of the container 102 are made of an elastic material so that their lower edges elastically contact the surface of the dispenser roller 104. As shown in FIG. 4, a number of recesses 118 may be formed in the lower edge of the front wall 105, and a plurality of recesses or grooves may be formed on the surface of the dispenser roller 104 by, for example, knurling.

In the dispenser 82 of the above construction, toner particles 120 are accommodated in the container 102. When the dispenser roller 104 is rotated in the direction shown by arrow 116 by the electric motor 114, the toner particles 120 in the container 102 are discharged as shown by arrow 122 (FIG. 3) in response to the rotation of the dispenser roller 104, and dispensed to the developer container 78. Supply of toner particles 120 to the container 102 may be effected by removing a closure member 124 (FIG. 2) mounted detachably on the top surface of the housing 74 and manually loading toner particles 120 into the container 102 through the resulting opening and the toner supply opening 110 at the top of the container 102.

The agitating member 82 may be formed of a plate-like main blade 126 and a plurality of semi-helical auxiliary blades 128 disposed on both sides thereof, as shown in FIG. 4. The agitating member 84 is rotated in the direction shown by arrow 130 in FIG. 3 to mix the developer 76 separated from the surface of the rotary sleeve 88 in the separating zone 98 and toner particles 120 dispensed to the developer container 78 from the toner dispenser 82 with the developer 76 present at the bottom of the developer container 78, and to agitate the mixture. Thus, the carrier particles and the toner particles in the developer 76 are uniformly mixed, and simultaneously the toner particles are triboelectrically charged.

In the developing device 14 described hereinabove, the agitating member 84 and the rotary sleeve 88 are drivingly connected to a main electric motor (not shown) provided, for example, in the electrostatic copying apparatus, and are rotated as the copying process by the electrostatic copying apparatus is started and the rotary drum 8 is rotated. Their rotation is stopped in response to the stopping of the rotation of the rotary drum 8. The dispenser roller 104 of the toner dispenser 82 is drivingly connected to the electric motor 114 (FIG. 2) and is rotated independently of the agitating member 84 and the rotary sleeve 88 in response to the performance of a copying process by the electrostatic copying apparatus. Referring to FIG. 1, a detecting means 132 for detecting a copying paper is disposed at a predetermined position in a conveying path for the copying paper fed and conveyed by the conveying system 42, for example at a position near the upstream end of the guide plates 50. While the detecting means 132 is detecting the presence of copying paper (i.e., during the time from the arrival of the forward end of the sheet of copying paper at the detecting position of the detecting means 132 to the departure of the rear end of the sheet of copying paper from the detecting position of the detecting means 132), the electric motor 114 is operated to rotate the dispenser roller 104 and therefore to dispense toner particles from the dispenser 82 to the developer container 78.

In the illustrated developing device 14, the dispenser roller 104 is rotated for a time span corresponding to the length of the sheet of copying paper conveyed through the paper conveying passage every time a copying process is performed by the electrostatic copying apparatus and therefore every time the developing device 14 performs development. Accordingly, for each cycle of the copying operation, toner particles in an amount corresponding to the length of the sheet of copying paper are dispensed to the developer container 78 from the dispenser 82. As a matter of fact, the amount of toner particles consumed by the development operation of the developing device 14 in each copying cycle, namely the amount of toner particles applied to the latent electrostatic image formed on the photosensitive member on the rotary drum 8, does not correspond to the length of the sheet of copying paper conveyed through the paper conveying passage, but varies considerably depending upon the characteristics of the latent electrostatic image to be developed, for example depending upon whether a background portion free from toner particles is broader in area than a solid black portion having many toner particles adhering thereto, or vice versa. Accordingly, if the copying process is repeatedly performed by the electrostatic copying apparatus, the amount of the developer 76 present in the developer container 78 varies considerably, and excessively increases or decreases. As stated previously, the excessive decrease of the amount of the developer 76 in the container 78 causes the insufficient development phenomenon, and the excessive increase thereof causes the background fog. The excessive decrease of the amount of the developer 76 present in the developer container 78 can be avoided by adjusting the amount of the toner particles 120 fed to the developer container 78 during the rotation of the dispenser roller 104 for a time interval corresponding to the length of a sheet of copying paper to a somewhat larger amount than the amount of toner particles actually consumed, and this adjustment can be effected, for example, by properly selecting the dimensions and configurations of the individual constituent elements of the toner dispenser 82 or the rotating speed of the dispenser roller 104. This, however, would result in a greater tendency toward the excessive increase of the amount of the developer 76 present in the developer container 78.

The developing device 14 improved in accordance with this invention is equipped with a toner particle dispensing inhibitor means which makes the toner dispenser 82 unable to start a toner dispensing action (in the illustrated embodiment, the dispenser roller 104) when a sufficient amount of the developer 76 is present in the developer container 78 and dispensing of toner particles 120 to the developer container 78 from the toner dispenser 82 is likely to increase the amount of the developer 76 in the container 78 excessively. This toner dispensing inhibitor means acts to positively prevent the excessive increase of the amount of the developer 76 in the developer container 78, and the amount of the developer 76 in the container 78 can always be maintained within the desired range.

Figure 5:
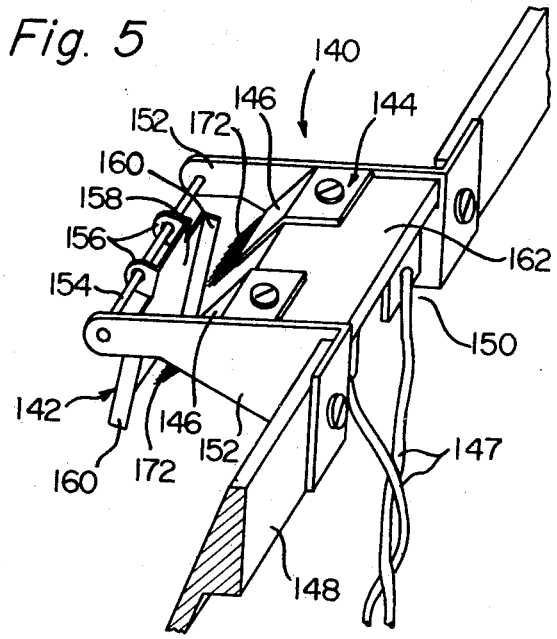
FIG. 5 is a perspective veiw showing a part of the developing device in the electrostatic copying apparatus shown in FIG. 1.
Figure 6:
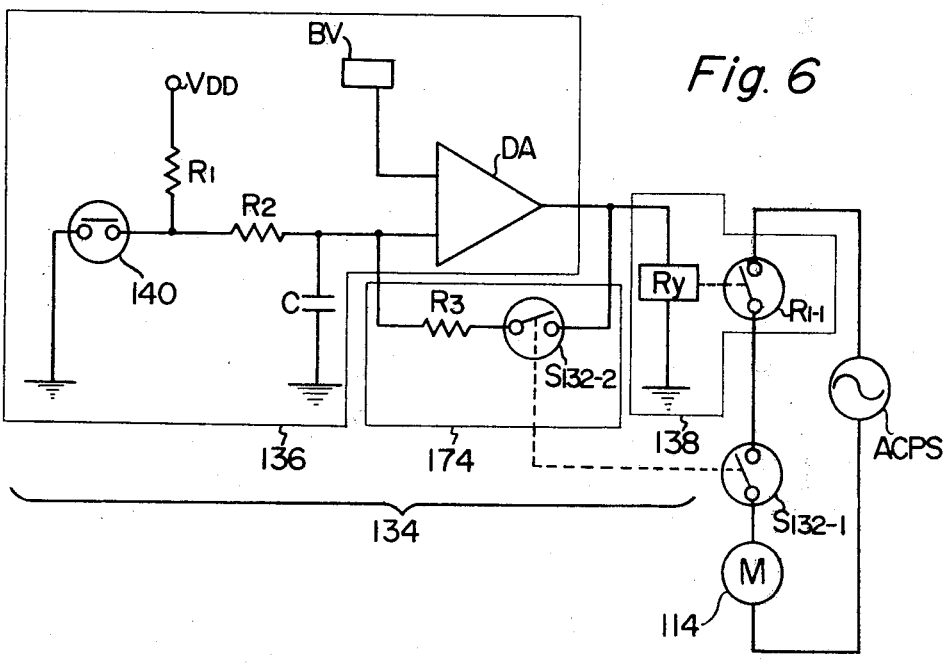
FIG. 6 is a circuit diagram showing that part of the electrical circuit in the electrostatic copying apparatus shown in FIG. 1 which is related to the developing device.

Referring to FIGS. 5 and 6, especially FIG. 6, taken in conjunction with FIGS. 3 and 4, the toner particle dispensing inhibitor means 134 in the illustrated embodiment includes a detecting unit 136 and a toner particle dispensing inhibitor 138. The detecting unit 136 detects the amount of the developer 76 present in the developer container 78, and when a sufficient amount of the developer 76 is present in the developer container 78, generates a signal for stopping or preventing the start of the dispensing of toner particles. The toner particle dispensing inhibitor 138 stops or prevents the toner dispensing action of the toner dispenser 82 to fail while the detecting unit 136 is generating the aforesaid signal for inhibiting the dispensing of toner particles.

The detecting unit 136 in the illustrated embodiment includes an electrical switch unit 140 disposed at a predetermined position in the developing device 14. The switch unit 140 is described further with reference to FIGS. 3 to 5, especially FIG. 5. The switch unit 140 is constructed of a movable member 142 made of an electrically conductive material and a fixed member 144 composed of a pair of electrodes 146. As clearly shown in FIGS. 4 and 5, a rectangular recess 150 is formed in the longitudinally middle portion of a member 148 defining part of the developing housing 74. A pair of support plates 152 projecting forwardly are fixed to the two side ends of the recess 150, and a rod 154 having a circular cross section is mounted between the ends of the support plates 152. By rotatably connecting a pair of connecting pieces 156 formed on the upper end of the movable member 142 to the rod 154, the movable member 142 is mounted so that it is oscillatable around the rod 154. As will be described in greater detail hereinbelow, the movable member 142 preferably has a receiving portion 158 with which a stream of the developer 76 caused to flow by the agitating action of the agitating member 84 collides, and a pair of contacting portions 160 projecting rearwardly from the back surface of the receiving portion 158. An installing plate 162 made of an insulating material is fixed to the facing sides of the support plates 152, and a pair of electrodes 146 constituting the aforesaid fixed member 144 are fixed at a predetermined interval therebetween to the edge portions of the installing plate 162. Each of the electrodes 146 extends in an inclined manner forwardly and downwardly from its base portion fixed to the edge portion of the installing plate 162. The base of each of the electrodes 146 is connected to an electric circuit (to be described in detail hereinbelow with reference to FIG. 6) constituting detecting unit 136 by a lead wire 147.

The action of the aforesaid electrical switch unit 140 is described mainly with reference to FIG. 3. When the agitating member 84 is at rest, the movable member 142 is located at the position shown in FIG. 3 at which it extends straight down from the rod 154 due to its own weight. When a copy cycle of the electrostatic copying machine is started and the rotary sleeve 88 of the developer applicator 80 is rotated in the direction shown by arrow 86, the agitating member 84 is rotated in the direction shown by arrow 130. As a result, the developer 76 present in the developer container 78 is agitated by the agitating action of the agitating member 84. Thus, the developer 76 is raised in the direction shown by arrow 164, and is further caused to flow in the direction shown by an arrow 166. The developer 76 flowing in the direction of arrow 166 by the agitating action of the agitating member 84 contains a small proportion of developer which is separated from the surface of the rotary sleeve 88 in the separating zone 98 and is caused to flow down onto the agitating member 84. The flow of the developer 76 in the direction of the arrow 166 collide with the receiving portion 158 (FIGS. 4 and 5) of the movable member 142 to swing the movable member 142 in the direction of arrow 168. If at this time, the amount of the developer 76 which flows in the direction of arrow 166 is relatively large, each contacting part 160 of the movable member 142 contacts the electrodes 146 constituting the fixed member 144, and therefore, an electric current is passed between the electrodes 146 via the movable member 142. On the other hand, if the amount of the developer 76 flowing in the direction of arrow 166 is relatively small, the contacting parts 160 of the movable member 142 do not make contact with the electrodes 146. Accordingly, while the agitating member 84 rotates in the direction of arrow 130 and is performing an agitating action, the movable member 142 is oscillated relatively minutely in the direction of arrow 168 and in the direction of arrow 170 in response to variations in the amount of the developer 76 which flows in the direction of arrow 166. Thus, a pair of contacting parts 160 of the movable member 142 repeatedly make contact with, and separate from, the electrodes 146 constituting the fixed member 144, and the electrodes 146 are repeatedly placed in the conducting state and in the non-conducting state. The ratio of the time during which the contacting parts 160 of the movable member 142 are in contact with the electrodes 146 to the time during which they are spaced from the electrodes 146, i.e. the ratio of the time during which the electrodes 146 are in the conducting state to the time during which they are not conducting, substantially corresponds to the amount of the developer 76 present in the developer container 78. In other words, when the amount of the developer 76 present in the developer container 78 increases, the ratio of the time during which the electrodes 146 are in the conducting state increases. Conversely, if the amount of the developer 76 present in the developer container decreases, the ratio of the time during which the electrodes 146 are in the conducting state decreases. Hence, the amount of the developer 76 present in the developer container 78 is detected by the state of contact and separation of the movable member 142 with and from the fixed member 144 (i.e., the state of opening and closing of the electrical switch unit 140), and therefore by the states of conducting and non-conducting between the electrodes 146.

Desirably, at least one of at least the end portions of the contacting parts 160 of the movable member 142 and at least the end portions of the electrodes 146 is made of an electrically conductive brush in order that an electric current can be passed accurately between the electrodes 146 during light contact between the contacting parts 160 of the movable member 142 and the electrodes 146 of the fixed member 144 even when they are slightly contaminated by the toner particles. In the illustrated embodiment, as clearly shown in FIG. 5, the end portion of each of the electrodes 146 is made of an electrically conductive brush 172.

While in the illustrated embodiment, the movable member 142 is adapted to move toward the fixed member 144 by the action of the developer 76 flowing in the direction of arrow 166, it should be understood that a similar operation and result can be achieved by a construction in which the movable member 142 normally in contact with the fixed member 144 while the agitating member 84 is at rest is moved away from the fixed member 144 by the action of the developer 76 caused to flow by the agitating action of the agitating member 84. In this alternative, when the amount of the developer 76 present in the developer container 78 increases, the ratio of the time during which the electrodes 146 constituting the fixed member 144 are in the conducting state decreases, and conversely, if the amount of the developer 76 in the container 78 decreases, the ratio of the time during which the electrodes 146 are in the conducting state increases. Furthermore, while in the illustrated embodiment, the movable member 142 is biased to the position shown in FIG. 3 by its own weight, it is possible, if desired, to bias the movable member 142 elastically to the desired position by a suitable spring so that the flow of the developer 76 generated by the agitating action of the agitating member 84 moves the movable member 142 against the biasing action of the spring.

With reference mainly to FIG. 6, the detecting unit 136 is comprised of the electrical circuit including the electrical switch unit 140 described above. The detecting unit 136 includes a condenser C capable of being charged from a power supply terminal $V_{DD}$ via resistances $R_1$ and $R_2$. The switch unit 140 is repeatedly opened and closed as described hereinbefore. When the switch unit 140 is open (therefore, the electrodes 146 are in the non-conducting state), the condenser C is charged via the power supply terminal $V_{DD}$ through the resistances $R_1$ and $R_2$. When the switch unit 140 is closed (therefore, the electrodes 146 are in the conducting state), the charge built up in the condenser C is discharged to ground through the resistance $R_2$ and the switch unit 140. Hence, the terminal voltage of the condenser C varies depending upon the opened and closed state of the switch unit 140. When the ratio of the time during which the switch unit 140 is closed increases, the terminal voltage of the condenser C decreases, and conversely when the ratio of the time during which the switch unit 140 is closed decreases, the terminal voltage of the condenser C increases. The terminal voltage of the condenser C is supplied to a differential amplifier DA which compares the terminal voltage of the condenser C with a reference voltage supplied from a reference voltage source BV. When the terminal voltage of the condenser C is higher than the reference voltage, the differential amplifier DA generates a voltage output. But when the terminal voltage of the condenser C is lower than the reference voltage, the output of the differential amplifier DA becomes zero (in the illustrated embodiment, this zero output constitutes a signal for inhibiting the dispensing of toner particles).

Thus, when the dispensing of toner particles 120 from the toner dispenser 82 to the developer container 78 is not likely to increase the amount of the developer 76 excessively, the ratio of the time during which the switch unit 140 is closed is relatively low even when the agitating member 84 has started its agitating action. Accordingly, the detecting unit 136 generates a voltage output at the output terminal of the differential amplifier DA. However, when a sufficient amount of the developer 76 is present in the developer container 78 and further dispensing of toner particles 120 to the developer container 78 from the toner dispenser 82 is likely to cause an excessive increase in the amount of the developer 76, the switch unit 140 is closed in a relatively high time ratio upon the starting of the agitating action of the agitating member 84. Hence, the output of the differential amplifier DA of the detecting unit 136 becomes zero, and the detecting unit 136 generates a signal for inhibiting the dispensing of the toner particles.

The level of the amount of the developer 76 in the container 78 at which the detecting unit 136 produces a signal for inhibiting the dispensing of toner particles can be easily controlled, for example, by adjusting the reference voltage supplied from the reference voltage source BV to the differential amplifier DA.

The illustrated toner particle dispensing inhibitor 138 which operates according to whether the output of the detecting unit 136 is zero (therefore, the detecting unit 136 is producing a signal for inhibiting the dispensing of toner particles) includes a relay $R_y$ connected to the output terminal of the differential amplifier DA of the detecting unit 136. When a voltage output is supplied from the differential amplifier DA, the relay $R_y$ is energized to close its contact $R_{1\text{-}1}$. Conversely, when the output of the differential amplifier DA is zero and therefore, the detecting unit 136 is producing a signal for inhibiting the dispensing of toner particles, the relay $R_y$ is deenergized to open its contact $R_{1\text{-}1}$.

The contact $R_{1\text{-}1}$ of the relay $R_y$ is connected in series between an electric motor 114 (see also FIG. 2) for rotating the dispenser roller 104 of the toner particle dispenser 82 and an ac power supply ACPS for supplying power to the electric motor 114. Also connected in series between the electric motor 114 and the ac power supply ACPS is a normally open contact $S_{132-1}$ which is closed while the detecting means 132 (FIG. 1) provided in the path of conveying copying paper is detecting a sheet of copying paper, namely during the time from the arrival of the forward end of the sheet of copying paper at the detecting position of the detecting means 132 to the departure of the rear end of the sheet of copying paper from the detecting position of the detecting means 132.

While the differential amplifier DA is producing a voltage output and therefore the relay $R_y$ is energized to close the contact $R_{1-1}$, a sheet of copying paper is conveyed during a copy cycle performed by the electrostatic copying apparatus. When the forward end of the sheet of copying paper arrives at the detecting position of the detecting means 132 and the detecting means 132 detects it to close the normally open contact $S_{132-1}$, power is supplied to the electric motor 114 and the dispenser roller 104 (FIG. 3, etc.) is rotated by the electric motor 114, thus starting the action of dispensing toner particles form the toner dispenser 82 to the developer container 78. This toner dispensing action is continued until the rear end of the sheet of copying paper is conveyed past the detecting position of the detecting means 132 and the normally open contact $S_{132-1}$ is opened. However, when the output of the differential amplifier DA is zero and therefore the detecting unit 136 is producing a signal for inhibiting the dispensing of toner particles, the relay $R_y$ of the toner dispensing inhibitor 138 is deenergized to open its contact $R_{1-1}$. Accordingly, even when the detecting means 132 has detected the copying paper and the normally open contact $S_{132-1}$ has been closed, electric power is not supplied to the electric motor 114, and therefore, the action of dispensing toner particles from the toner dispenser 82 to the developer container 78 cannot be started.

In the illustrated developing device 14, when the dispenser roller 104 of the toner dispenser 82 is rotated to dispense toner particles 120 to the developer container 78, the toner particles 120 from the dispenser 82 fall in the direction of arrow 122 and are dispensed to the container 78, as described above mainly with reference to FIG. 3. Hence, the toner particles 120 from the toner dispenser 82 directly fall onto the agitating member 84, and are associated with the stream of the developer 76 which is caused to flow in the direction of arrow 166 by the agitating member 84. Accordingly, once the toner dispenser 82 has begun its toner dispensing action, the detecting unit 136 tends to detect the amount of the developer 76 present in the developer container 78 as an amount larger than the actual amount of the developer 76 present therein because the toner particles 120 supplied from the toner dispenser 82 fall directly into the flow of the developer 76 in the direction of arrow 166.

In view of this tendency of the detecting unit 136, the toner particle dispensing inhibitor means 134 in the illustrated embodiment further includes a toner particle supply continuing means which once the toner particle dispenser 82 has begun its action of supplying toner particles, makes the detecting unit 136 unable to produce a signal for inhibiting toner dispensing until the toner particle dispensing action of the toner dispenser 82 is continued for a predetermined period of time.

The toner particle supply continuing means shown at 174 in FIG. 6 is constructed of electrical networks connected in parallel between one input end (i.e., the input end from which to supply a terminal voltage of the condenser C) of the differential amplifier DA of the detecting unit 136 and the output end of the differential amplifier DA. The electric circuit includes a normally open contact $S_{132-2}$ and a resistance $R_3$ connected to each other in series. The normally open contact $S_{132-2}$ is adapted to be opened and closed in interlocking relation with the normally open contact $S_{132-1}$ described hereinabove, and therefore, is closed while the detecting means 132 (FIG. 1) disposed in the path of the conveyed copy paper is detecting the presence of the copy paper.

In the illustrated embodiment having the aforesaid means 174 for continuing the dispensing of toner particles, while the detecting means 132 is detecting the presence of the copying paper and the normally open contact $S_{132-2}$ is closed, the output of the differential amplifier DA is fed back to the input end via the normally open contact $S_{132-2}$ and the resistance $R_3$, and is therefore maintained constant. Thus, while the contact $R_{1-1}$ of the toner particle dispensing inhibitor 138 is closed as a result of the production of a voltage output by the differential amplifier DA (therefore, the detecting unit 136 is not producing a signal for inhibiting the supply of toner particles), and the forward end of a sheet of copying paper arrives at the detecting position of the detecting means 132, the normally open contacts $S_{132-1}$ and $S_{132-2}$ are closed and thereby the toner particle dispensing action of the toner dispenser 82 is started. Once the toner dispensing action has thus been started, the output voltage of the differential amplifier DA is maintained (therefore, the detecting unit 136 is unable to produce a signal for inhibiting the supply of toner particles), and the contact $R_{1-1}$ of the toner dispensing inhibitor 138 is maintained closed, until the rear end of the sheet of copy paper is past the detecting position of the detecting means 132 to open the normally open contacts $S_{132-1}$ and $S_{132-2}$. Accordingly, until the rear end of the sheet of copy paper is past the detecting position of the detecting means 132 to open the normally open contacts $S_{132-1}$ and $S_{132-2}$, the toner dispensing action of the toner dispenser is continued without interruption.

While one specific embodiment of the developing device constructed in accordance with this invention has been described hereinabove with reference to the accompanying drawings, it is obvious that the invention is not limited to the specific embodiment shown in the drawings, and various changes and modifications are possible without departing from the scope and spirit of the invention.

For example, while the present invention has been described hereinabove with reference to a specific type of electrostatic copying apparatus and a specific type of developing device, the present invention is not limited to such specific types of electrostatic copying apparatus and developing device, but can also be applied to various types of developing devices in various types of electrostatic copying apparatus.

What we claim is:

1. A developing device for an electrostatic copying apparatus, said developing device comprising: a developer container; a developer applicator for holding on its surface a part of a developer present in said developer container for applying toner particles to a latent electrostatic image to be developed; a rotary agitating member in said developer container for agitating the developer for causing it to move in a flow; a toner particle dispenser for dispensing toner particles therein into said developer container, said toner particle dispenser being controlled for performing a toner particle dispensing action in response to the performance of a copying process of the electrostatic copying apparatus; a toner particle dispensing inhibitor connected with said toner particle dispenser for causing said toner particle dispenser to remain inoperative when said toner particle inhibitor supplies a signal thereto, and a detecting means connected to said toner particle inhibitor and having an electrical switch unit having a fixed member in said developer container and a movable member oscillatably mounted in said developer container and movable between a position in which it is in contact with said fixed member and a position in which it is out of contact with said fixed member, said movable member being positioned to be acted on by the flow of developer for moving said movable member from one position to the other when the amount of developer in said container is sufficient, and means for producing a signal for said toner particle dispensing inhibitor in response to the said switch unit being in said other position.

2. The developing device of claim 1 further comprising developing present in the developer container which is composed of magnetic carrier particles and toner particles.

3. The developing device of claim 1 wherein said toner dispenser is positioned above said agitating member, whereby toner particles dispensed from said toner dispenser into said developer container are caused to fall toward said agitating member.

4. The developing device of claim 2 or 3 further comprising a separating member disposed in proximity to said rotary agitating member for separating the developer from the surface of said developer applicator in a peeling zone located downstream of a developing zone where the developer held on the surface of said developer applicator is applied to a latent electrostatic image and for directing the developer separated from the surface of said developer applicator toward said agitating member.

5. The developing device of claim 4 wherein said developer applicator includes a cylindrical rotary sleeve and a stationary permanent magnet disposed within said sleeve, said rotary sleeve being adapted to hold the developer magnetically thereon by the action of a magnetic field generated by said permanent magnet, and at said separating position, the magnetic field generated by said permanent magnet is extremely weak or absent.

6. The developing device of claim 4 wherein said developer applicator is a type for magnetically attracting a part of the developer present in said developer container in a draw-up zone and holding it on its surface, carrying such developer to a developing zone and applying it to the surface of a photosensitive member having a latent electrostatic image formed thereon and which is being moved through said developing zone; and a brush length-adjusting member for adjusting the thickness of the developer layer on the surface of the applicator to a predetermined value and positioned between said draw-up zone and said developing zone, said brush length-adjusting member having a main part extending to a position in proximity to the surface of said developer applicator between said draw-up zone and said developing zone and an extension extending from the end of said main part gradually away from the surface of said developer applicator to a position in proximity to the surface of said photosensitive member so as to prevent scattering of the toner from said developer zone.

7. The developing device of claim 4 further comprising a housing having an opening formed at a position opposed to the surface of said rotary drum, said developer container being in the lower portion of said housing, said developer applicator being positioned within said housing and magnetically attracting a part of the developer present in said developer container to its surface, carry such developer and apply it to the surface of said photosensitive member through said opening, and said brush length-adjusting member having a base part fixed to the lower part of the front surface of said housing, said main part extending upwardly from said base part toward the surface of said developer applicator and said extension extending from the forward end of said main part toward the surface of said photosensitive member.

8. The developing device of claim 1 wherein said toner particle dispenser includes a toner particle container having an opening at its bottom and a dispenser roller rotatably disposed in said opening so that the toner particles in said toner container are discharged by the rotation of said dispenser roller; and said toner particle dispensing inhibitor comprises means for making said dispensing roller unable to start rotation while said detecting unit is producing a signal for inhibiting the dispensing of the toner particles.

9. The developing device of claim 1 wherein said movable member of said electrical switch unit is mounted for being held at a position spaced apart said fixed member due to its own weight when there is no flow of the developer being caused by the agitating action of said rotary agitating member.

10. The developing device of claim 9 wherein said fixed member of said electrical switch unit includes a pair of electrodes adapted to be conducting upon contact of said movable member therewith.

11. The developing device of claim 10 wherein said detecting means comprises means for producing said signal for inhibiting the dispensing of the toner particles according to the ratio between the time of conducting and the time of non-conducting of said movable and fixed members as said members are respectedly brought into contact and separated by the flow of the developer.

12. The developing device of claim 10 wherein said movable member of said electrical switch unit has a receiving portion and a pair of contacting portions projecting rearwardly from the back surface of the receiving portion, and the flow of the developer caused by the agitating action of said rotary agitating member collides with the receiving portion to move said movable member whereby each of said contacting portions is brought into contact with each of said electrodes of said fixed member.

13. The developing device of claim 12 wherein at least one of at least the end portions of said contacting portions of said movable member and at least the end portions of said electrodes of said fixed member is made of an electrically conductive brush.

14. The developing device of claim 6 wherein said developer applicator includes a cylindrical sleeve and a permanent magnet disposed within said sleeve, and the extension of said brush length-adjusting member extends at an angle of 90° to 110° with respect to the straight line connecting the center of said sleeve to the end of said main part of said brush length-adjusting member.

15. The developing device of claim 14 wherein said angle formed by said extension and said straight line is 95° to 105°.

16. The developing device of claim 6 wherein the distance between the end of said extension of said brush length-adjusting member and the surface of said photosensitive member is 0.5 to 1.5 mm.

17. The developing device of claim 16 wherein said distance is 0.8 to 1.2 mm.

18. The developing device of claim 1 which further includes means for continuing the dispensing of toner particles by making said detecting unit unable to produce a signal for inhibiting the dispensing of the toner particles until the toner particle dispensing action of the toner particle dispenser is completed once the toner dispenser has begun its toner dispensing action, and to continue the toner dispensing action of the toner dispenser once the toner dispenser has begun its toner dispensing action.

* * * * *